United States Patent [19]

Longenecker

[11] 4,328,388

[45] May 4, 1982

[54] ELECTRO FURNACE FEEDING AND FURNACE FUME UTILIZATION AND CONTROL

[76] Inventor: Levi S. Longenecker, 61 Mayfair Dr., Pittsburgh, Pa. 15228

[21] Appl. No.: 120,633

[22] Filed: Feb. 11, 1980

[51] Int. Cl.[3] ..... F27B 9/12

[52] U.S. Cl. ..... 373/80; 266/901; 414/207; 373/83

[58] Field of Search ..... 13/33, 35, 9, 9 ES; 266/901; 414/207, 199; 432/166, 179

[56] References Cited

U.S. PATENT DOCUMENTS

| | | | |
|---|---|---|---|
| 3,160,296 | 12/1964 | Tocher et al. | 414/207 |
| 3,253,723 | 5/1966 | Calderon | 414/207 |
| 3,439,909 | 4/1969 | Richards | 266/901 |
| 3,479,438 | 11/1969 | Longenecker | 13/33 |
| 3,537,694 | 11/1970 | Rinesch et al. | 266/901 |
| 3,632,094 | 1/1972 | Longenecker | 266/901 |
| 4,115,654 | 9/1978 | Wooding et al. | 13/9ES |
| 4,146,742 | 3/1979 | Longenecker | 13/35 |

FOREIGN PATENT DOCUMENTS

| | | | |
|---|---|---|---|
| 1458844 | 1/1969 | Fed. Rep. of Germany | 414/207 |

*Primary Examiner*—B. A. Reynolds
*Assistant Examiner*—Bernard Roskoski
*Attorney, Agent, or Firm*—Parmelee, Miller, Welsh & Kratz

[57] ABSTRACT

A metal melting furnace is provided having an enclosing roof that has a refractory brim portion affixed to and carried by the side walls, and has a refractory crown portion that is adapted to be removably positioned to close-off and open a central charging opening defined and encompassed by the brim portion. The crown portion by-passes electrodes in its "down" position and is to be raised and lowered and swung into and out of a clearing position with respect to the charging opening. Exhaust fume from a side-positioned smoke hole of the furnace is directed either into and positively drawn through a side-positioned-preheating scrap container or through an exhaust chest for subsequent environmental treatment before discharge into the atmosphere. The preheating container has a chamber divided into a front high temperature compartment and a back lower temperature compartment through which hot exhaust fume from the furnace exhaust port is fed in a reverse manner from a bottom opening in the high temperature compartment. A top hood-like lid is carried by the upper end of the container and is adapted to swing into a downwardly declining scrap-mixing and guiding, open position when the container is tilted forwardly on its platform. To cooperate with and limit the down swing of the lid, to guide down-flow of the scrap, and to protect the feed opening in the furnace during the charging operation, a swing guide funnel is employed.

19 Claims, 8 Drawing Figures

ELECTRO FURNACE FEEDING AND FURNACE FUME UTILIZATION AND CONTROL

FIELD OF THE INVENTION

This invention relates to improved electric melting furnace equipment and procedure for facilitating scrap feeding in such a manner that better furnace maintenance, charging and melting utilization may be attained. Another phase of the invention deals with flowing hot furnace exhaust fume to effect efficient preheating of scrap metal charging material and to assure a maximum of environmental protection, irrespective of whether or not a preheating container is in a fume flow receiving position with respect to the furnace.

DISCUSSION OF PRIOR ART

Heretofore, it has been customary to provide the furnace with a fully removable roof such that it has a maximum size of charging opening that is defined by the circumference of its side walls, and to provide scrap clam buckets which are swung into and out of an overhead charging position by a crane hoist. Each bucket is provided with means for opening its pair of bottom leaves when it is in alignment above the furnace mouth to directly feed its scrap vertically as a substantially unitary body upon the bottom furnace refractories. This has the disadvantage of requiring manipulating means to open the scrap buckets, and the direct gob-like fall of the scrap increases wear and tear on the refractory bottom and sides of the furnace. Also, as indicated by my U.S. Pat. No. 3,632,094, upright preheating scrap containers have been before provided in which scrap is preheated by some suitable means, such as furnace gas or gas from an auxiliary furnace as disclosed in my U.S. Pat. No. 3,479,438.

To the best of my knowledge, at the present time, no simple and efficient arrangement has been developed in which furnace exhaust fume or gas is directly passed into and positively moved through a side-positioned, flow reversing preheating container that is then utilized to progressively feed a body content of scrap as a downwardly accurately guided stream through a central roof charging opening of restricted size and within encompassing confines of a fixedly mounted or side wall attached refractory roof brim portion.

There has been a need for an improved furnace exhaust fume utilizing and controlling process and for an improved furnace feeding type of operative procedure that will involve effective employment of a central charging opening in a refractory roof, that will enable a premixing-delivery of scrap having different levels of preheat, and that will minimize wear and tear on the refractory lining of the furnace. Also, it is important under present day conditions to minimize direct atmospheric discharge of exhaust fume during furnace operative procedures.

SUMMARY OF THE INVENTION

It has thus been an object of the invention to provide an improved approach to melting furnace utilization.

Another object has been to develop a better method of feeding metal scrap into a melting furnace and through a restricted size of charging opening in its roof.

Another object has been to devise a construction utilizing furnace fume exhaust in an efficient manner for preheating scrap to be used in the furnace and for assuring environmental treatment of furnace exhaust fume irrespective of whether it is being used for preheating or not.

A further object has been to devise a combined fume utilizing and scrap charging construction which will effectively use exhaust fume from the furnace in preheating scrap material to be fed into the furnace, and in such a manner that hotter and colder portions of preheated scrap will be premixed and fed in an accurately guided manner to avoid scrap off-spillage and minimize wear and tear on the furnace.

A still further object has been to protect the environment from furnace fume being discharged while, at the same time, making periodic effective utilization of the fume in preheating scrap material.

DETAILED DESCRIPTION

The invention has been illustrated from the standpoint of an electric furnace A whose electrodes (not shown) may be inserted through holes P (see FIG. 1) in a removable, refractory roof crown part C. The furnace A is shown having an upright metal support frame structure D for its refractory side walls which converge into a rounded refractory bottom. The upper ends of the structure D support and carry a metal ring, frame and hanger structure E in a normally attached or fixed relation with respect thereto to support an inwardly projecting or overhanging roof brim part B. As shown, the brim part B is a more or less fixed extension of the side wall structure, such that it remains in place during the charging of the furnace and serves to restrict or limit outflow of hot fume or gas from the furnace when its centrally located charging opening, defined by the part B, has been exposed by lifting its electrodes out of position, and then lifting and swinging its removable refractory crown part C to an out-of-the-way position for charging the furnace. It is thus apparent that the brim part B defines and encompasses the charging opening for the furnace which is thus of a restricted size as compared to a conventional furnace whose entire roof is to be raised for charging it with scrap by means of buckets.

Figure 1:
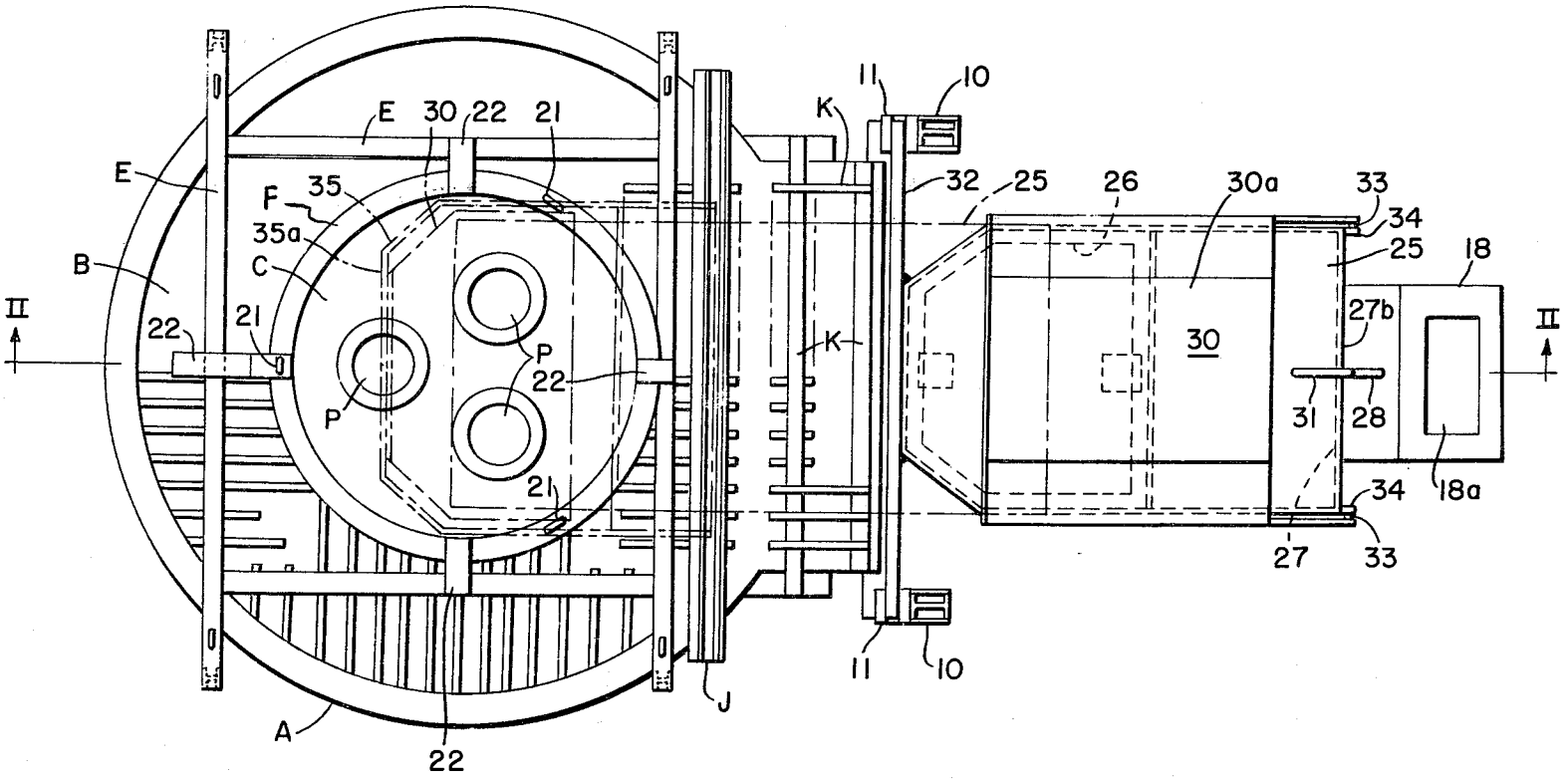
FIG. 1 is a greatly reduced top plan view of a furnace scrap charging construction embodying features of my invention; in this figure, a preheating container is shown in an upright scrap preheating position on a platform adjacent the furnace for receiving hot exhaust fume from a side exhaust port thereof.
Figure 3:
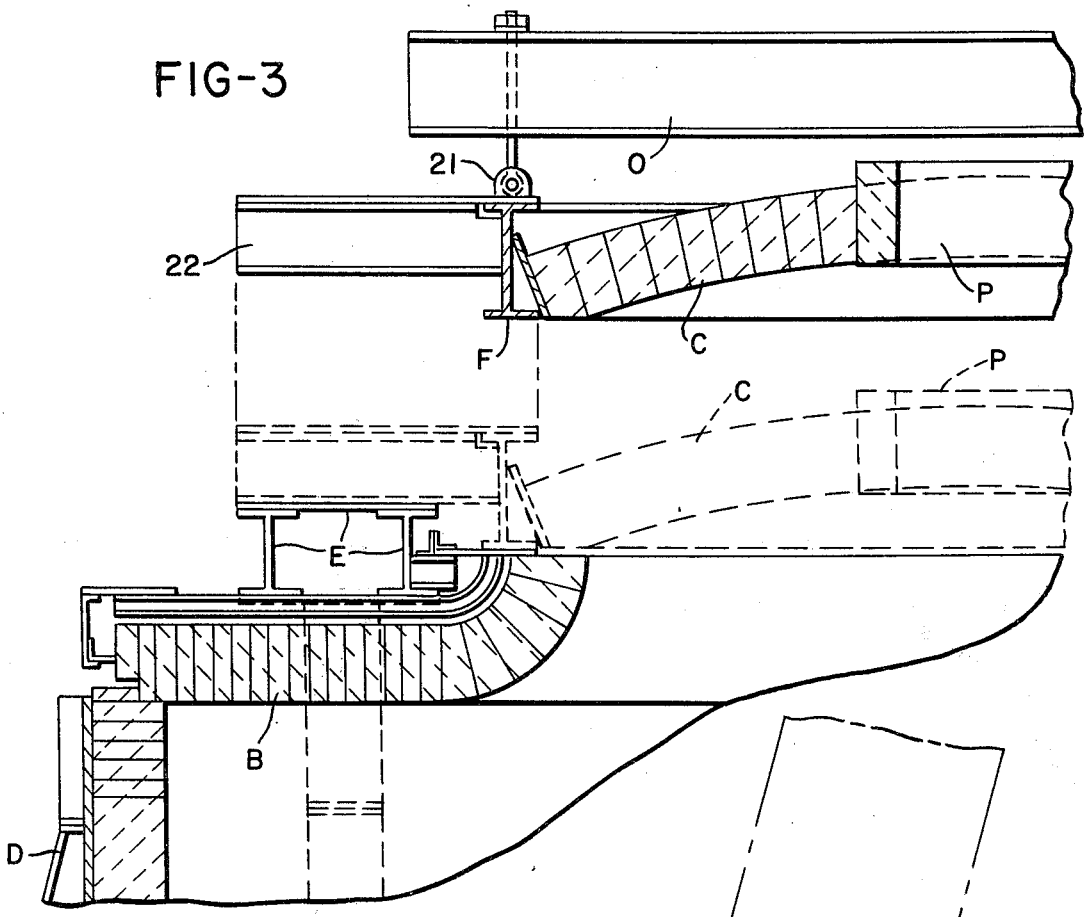
FIG. 3 is an enlarged fragmental section in elevation through the furnace of FIGS. 1 and 2 showing details of its construction and particularly, how its central crown portion may be lifted out of position to expose a charging mouth portion or opening; this view shows a furnace roof having a ring-supported out, side wall attached refractory brim portion that overhangs the top of the furnace, and a metal-ring supported cooperating central refractory crown portion through which electrodes may extend during the melting-down operation when the furnace roof is closed.

The roof crown part C, as particularly shown in FIGS. 1 & 3, is carried by an upwardly liftable and outwardly swingable metal ring frame F, see my U.S. Pat. No. 4,146,742. The crown part C is adapted to be raised and lowered and swung into and out of a roof closing-off position by means of an overhead lift and swing frame O, see particularly FIG. 3, that has a rod and knuckle or ear connection 22 therewith (see FIG. 3).

Figure 2:
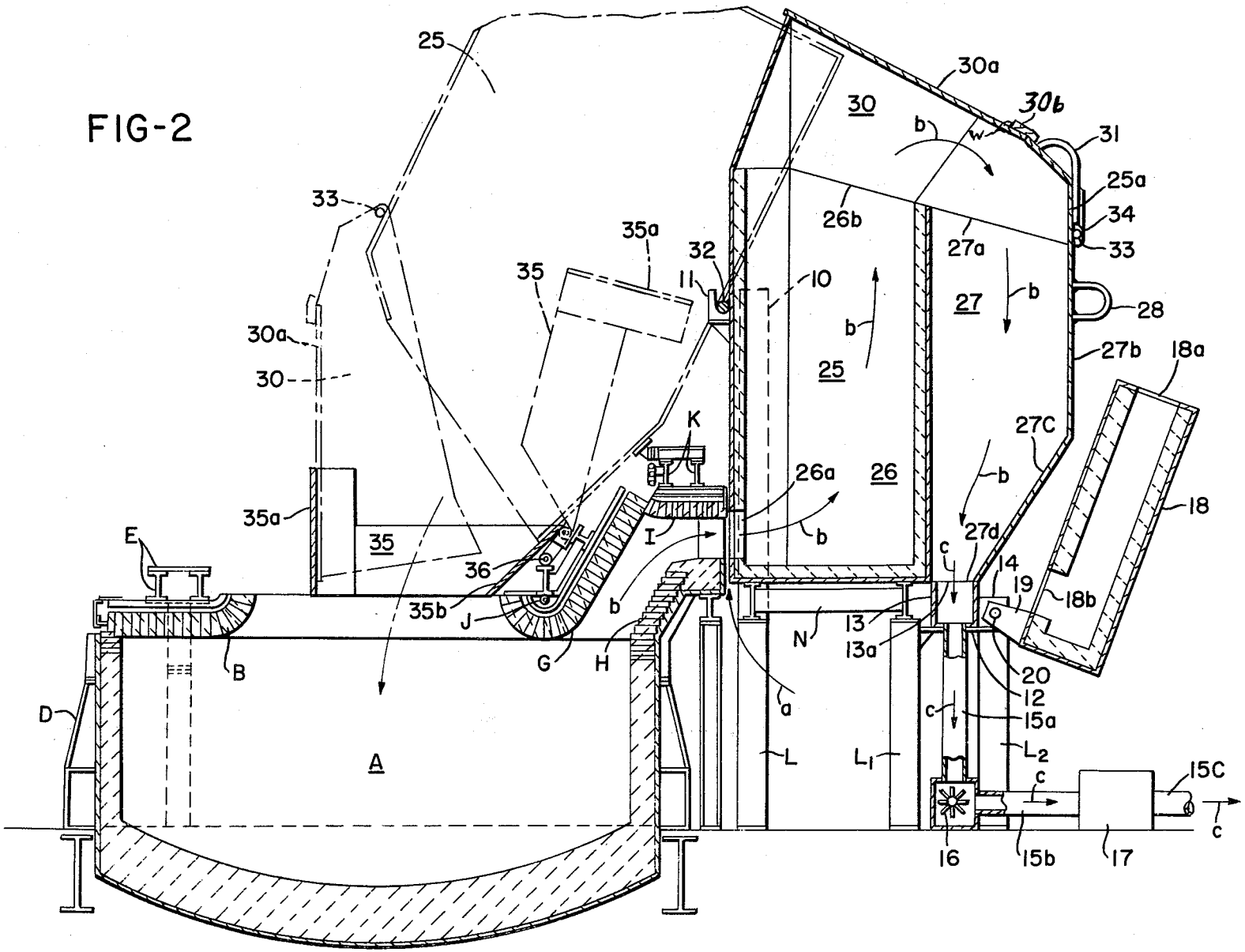
FIG. 2 is a side view in elevation and partial section taken along the line II—II of FIG. 1 showing in full lines the relative positioning of members of the construction when scrap is being preheated, and by dot and dash lines, the position of the scrap preheating container and swingable guide means consisting of a hood-like swing lid and a furnace mounted funnel when the container is tilted to discharge or feed scrap through a central charging opening in a refractory roof portion of the furnace.

Referring particularly to FIG. 2, a side-positioned refractory nose or apron roof portion G defines a so-called smoke hole with an upwardly outwardly diverging refractory back side wall portion H of the furnace. As shown, the side wall portion H extends backwardly to, in cooperation with a horizontally disposed and side-extending refractory roof segment or portion I, define an exhaust port for the furnace through which hot fume is to be discharged. Overhead metal support and hanger structure J carries the smoke hole refractory apron portion G, and metal support frame and hanger structure K carries adjoining, horizontally disposed, refractory side-extending portion I. See also FIG. 1.

Figure 7:
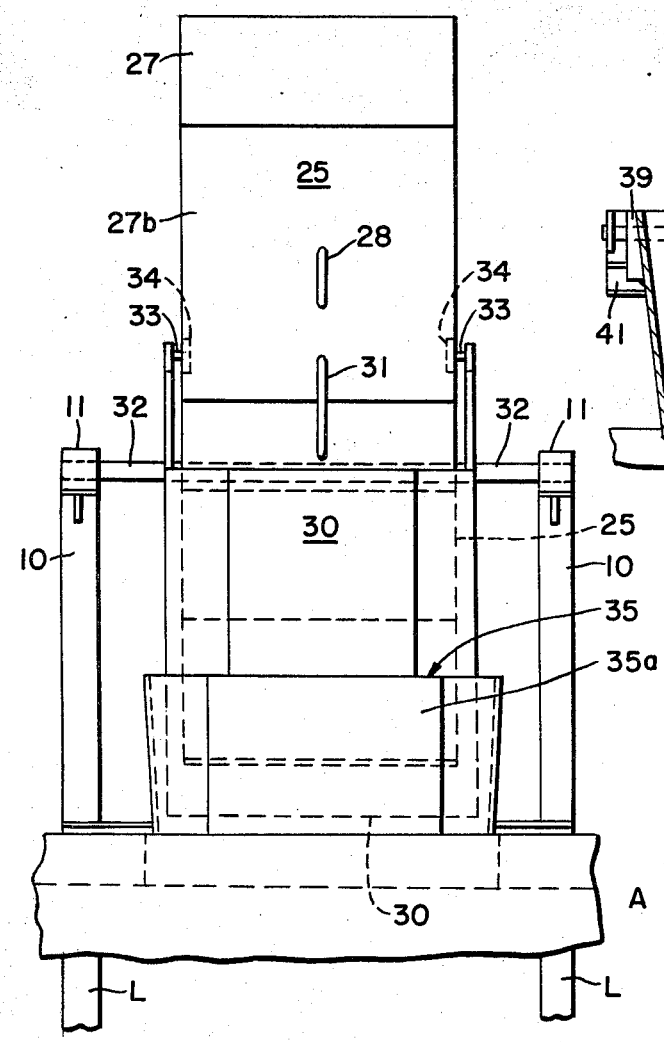
FIG. 7 is a front view in elevation of the construction of FIGS. 1 and 2 when the scrap preheating has been swung to a forwardly tilted furnace charging position on its supporting platform.

An upright scrap body receiving, conditioning and enclosing chamber is defined by a vertical elongated container 25 that is adapted to be carried in an upright position on a platform N adjacent to the side-positioned exhaust fume port of the furnace A for effecting a preheating operation. As particularly shown in FIGS. 1 and 2, the platform N is supported on a front pair of upright buckstays or column members L, an intermediate pair $L_1$ and a back-positioned pair $L_2$. The platform N has a front, upwardly extending pair of spaced-apart columns or support legs 10 that are adapted to pivotally or swingably receive and position the scrap container 25 thereon. As shown in FIGS. 2 and 7, the container 25 has a cross-extending pair of rod or shaft ends 32 that serves as swing pivot means and that may be downwardly entered and upwardly removed from a pair of forwardly extending, upwardly open-slot, swing support brackets 11. The brackets 11 are secured (see FIG. 7) to the legs 10 to swingably or pivotally carry the shaft ends 32 in such a manner as to enable the container 25 to be swung from its solid line vertical position of FIG. 2 to its forwardly downwardly inclined, dotted line, scrap charging position of the same figure.

The container 25, as particularly illustrated in FIG. 2, has a front, higher temperature preheating chamber portion 26 that is lined with refractory material. An inlet port **26*a* at its bottom side end portion is adapted to be directly aligned with the exhaust port in the furnace A when the container is in its upright, adjacent, side positioning on platform N, as shown by the full lines of FIG. 2. As indicated by arrow a, there is a slight spacing provided between the exhaust and inlet ports for enabling a cooling air tempering or dilution of the hot furnace fume to bring it down to a temperature that is suitable for a preheating operation, or that will not cause the particles pieces or granules of the scrap material to adhere or stick together. If the temperature of fume leaving the furnace A is about 2800 degrees F., the amount of air will be sufficient to cool it down to about 2000 degrees F. before it enters the preheating chamber 26. The tempered exhaust fume is adapted to, as shown by the arrows b, move upwardly through scrap material in the front, higher temperature preheating chamber portion 26, out of its open upper portion end 26*b*, along a passageway defined by a top hood-like, closing-off lid or door 30, and then through an open upper end portion 27*a* of a back-positioned, lower temperature chamber portion 27, downwardly into and out through scrap carried therein. The fume thus moves through the container and its backwardly positioned, lower temperature preheating chamber portion 27 in a reverse or inverted U-shaped flow path to exhaust in a cooled condition from discharge or outlet port 27*d*. The port 27*d* is open to discharge fume from the lower end of a downwardly converging side wall 27*c* of the chamber 27 into an exhaust fume receiving manifold 13 through its top inlet port 13*a***.

The manifold 13 is carried on a downwardly offset part 12 of the platform N. Arrow c indicates flow of fume from the bottom exhaust outlet or port **27*d*, through a manifold 13, duct line 15*a*, suction pump or fan unit 16, duct line 15*b* and a suitable fume cleaning unit 17 for discharge through duct line 15*c*. Positive movement of the fume from the exhaust port of the furnace A, through the two chamber portions of the container 25 and through the manifold 13 and along ductwork is provided by motor driven vacuum pump or fan suction unit 16. As shown in FIG. 2, fume passing from the pump 16 passes through duct 15*b* for introduction into cleaning unit 17 for environmental cleaning before it is discharged to the atmosphere or processed to recover its residual heat. The suction pump 16 may, if desired, be positioned in the duct line 15*c* on the "down" side of the cleaning unit 17 or, if additional suction is desired, the pump 16 may be retained in line 15*b* and a second suction pump may be positioned in the line 15*c*** (not shown).

For assuming minimized atmospheric contamination by furnace fume when the container 25 has, for example, been swung to a furnace-charging position or removed for recharging with scrap material, a refractory-lined exhaust chest 18 (see FIGS. 2, 5 and 6) has been provided that has a pair of swing arms 19 pivotally mounted by shaft 20 on a pair of ears 14 that extend from downwardly offset platform part 12. As indicated, the chest 18 is adapted to be swung by its shaft 20 from an out-of-the-way, backwardly inclined position of FIG. 2 to a horizontal, in-line position of FIG. 5 when, the container 25 is no longer connected with the exhaust port of the furnace A. As further shown in FIG. 5, the front end of the chest 18 has an inlet port 18*a* for direct alignment with the furnace side-positioned exhaust port, and has a bottom exhaust port 18*b* adjacent its back end which is adapted to align with the inlet port 13*a* of the manifold 13. As a result, hot fume will be positively moved from the furnace A through the ductwork system of FIG. 2, even when the preheating container 25 is out of position with respect to the platform N. It is contemplated that such exhaust by-passing will be continued when the furnace refractory crown portion C is in an open, furnace charging position. In this connection, the inward extension of the brim part B of the furnace roof plus the positive drawing action induced by the unit 16, assures a maximum drawing-off of furnace fume and gases even when the central charging opening is fully exposed and when scrap material is being charged into the furnace.

The preheating container 25 may use any suitable furnace charging scrap-like material, such as metal pieces, brickettes, etc., that are of a nature such that furnace exhaust gas fume may be flowed through the container 25, as induced by positive suction force generated by representative unit 16. The container 25 may have suitable lifting rings thereon, so that it may be lifted on and off the platform N, and placed on the plant floor for refilling, etc., as by an overhead crane or hoist. Also, as shown particularly in FIG. 2, the container 25 may also have a back-positioned hoist ring 21 and a top positioned tilt or swing ring 28. The ring 28 when used swings the container 25 forwardly on its pivot shaft 32 within the pair of brackets 11 from its fume-receiving, upright preheating position to a forwardly downwardly tilted, furnace charging position. At this time, as shown by the dot and dash lines of FIG. 2, the hood-like upper lip 30 will swing forwardly outwardly from its container-closing position to a final dot and dash position of this figure, against an upwardly extending, forward abutment end wall 35*a* of a guide funnel 35. It will be noted that a top wall portion 30*a* of the lid 30 has a tongue-like extension or a flange 30*b* that may be secured by weld metal w thereto to serve as a rest on an upper back wall extension portion 25*a* of container 25 for top wall portion 30*a* of the lid 30 when the container is in an upright position.

In the "down" scrap-feeding guiding position of the lid 30, its top wall portion 30*a* defines a scrap-guiding flow channel with its side walls that connects with and forms a flow path from the now open, upper ends 26*b* and 27*a* of the chambers of the container 25. And, a dual "out" mixing flow of scrap material is effected from the two open end portions 26*b* and 27*a* that results in a substantially equal proportioning of higher and lower temperature portions of the preheated scrap. The swing of the lid 30 (see FIGS. 2 and 7) is effected from side ears of its back end by the action of a pair of projecting rod ends or pins 33 that rotatably swivel or operate in a pair of upright arms 34 that are secured to extend from opposite sides of upper back wall portion 25*a* of the container 25. The substantially equal proportioning of hotter scrap from the forward chamber part 26 and of lower temperature scrap from the back chamber part 27 when the container 25 is moved to its forwardly, downwardly swiveled, inclined relationship and the lid 30 is swung to its open relationship, is advantageous in providing a scrap charge that uses a substantially uniform amount of furnace heat in melting it down in the furnace.

Figure 8:
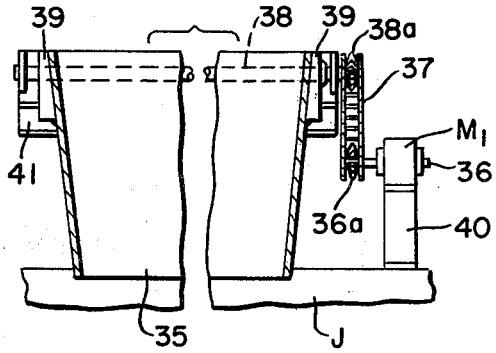
FIG. 8 is a front fragmental view in elevation on the scale of FIGS. 5 and 6 showing the swing mounting and operating mechanism for the guide funnel of FIG. 2.

To protect the refractories defining the central charging opening in the furnace A, and to positively guide scrap material from the container 25 through the charging opening without spillage, a funnel or guide means of collar-like shape 35 is provided. As shown in FIGS. 2 and 8, the funnel 35 may be pivotally mounted on the roof framework J for movement from a backwardly tilted, out-of-the-way position (shown by dot and dash lines in FIG. 2) to a substantially horizontal, full scrap guiding and refractory protecting position over the charging opening in the furnace (see the full lines of the same figure). At this time, the front end or roof portion 30*a* of the lid 30 is restricted by the front end wall 35*a* of the funnel 35, and its forward end extends a short distance within the funnel to define a guide passageway into the furnace through which the charging scrap material will flow or advance progressively from the container 25. As shown in FIG. 2, the collar-like guide 35 has a cooperating, substantially overlapping relation with the lid 30 and the forward end portion of the bucket 25, such that scrap spillage is avoided.

Figure 4:
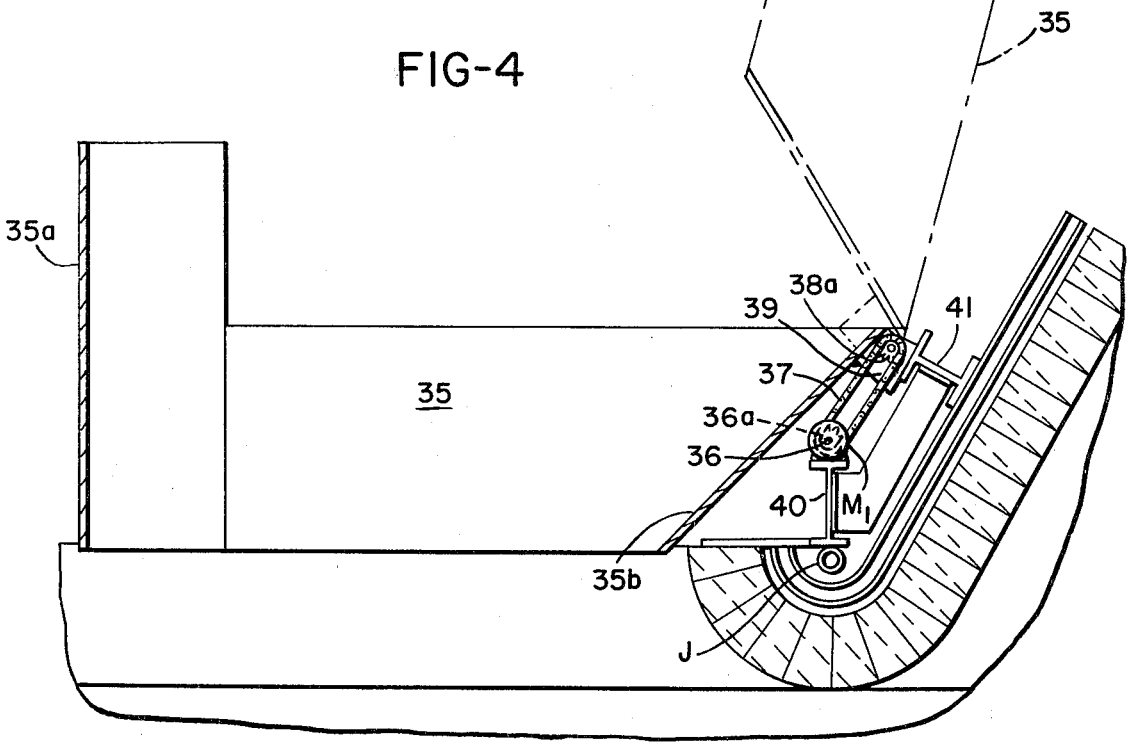
FIG. 4 is an enlarged fragmental side elevation on the scale of FIG. 3, particularly showing the construction and swing mounting of a guide funnel that is carried by the metal work of the furnace roof adjacent to its smoke hole for movement from the dot and dash out-of-the-way position to the full line, lower, scrap feed, guiding position when the furnace is being charged; this view illustrates motor and chain drive means for effecting a swinging operation of the guide funnel.

A motor $M_1$ for swinging the funnel 35 is shown mounted on a stand 40 (see FIGS. 4 and 8) that projects from the framework J. The motor $M_1$ has a drive shaft 36 and sprocket 36*a* thereon for actuating a chain 37, a sprocket 38*a*, and a swing shaft 38 that is secured to extend along a back extending end of a guide funnel 35 by end-positioned, reinforcing, mounting ears 39. In operation, the motor $M_1$ is energized to swing the guide funnel 35 forwardly in the previously described manner immediately before the container 25 and its lid 30 are swung to their respective feeding positions of FIG. 2. When the full emptying of the container 25 has been accomplished, then it may be tilted back and lifted by an overhead crane (not shown) to a convenient place in the plant for refilling it with scrap material. The funnel 35 may then be swung to its out-of-the-way, backwardly declining position, and the roof crown C, as well as the electrodes, moved back into their respective roof closing-off and operating positions. This, of course, depends upon whether the furnace A has been fully charged by a particular container.

Figure 5:
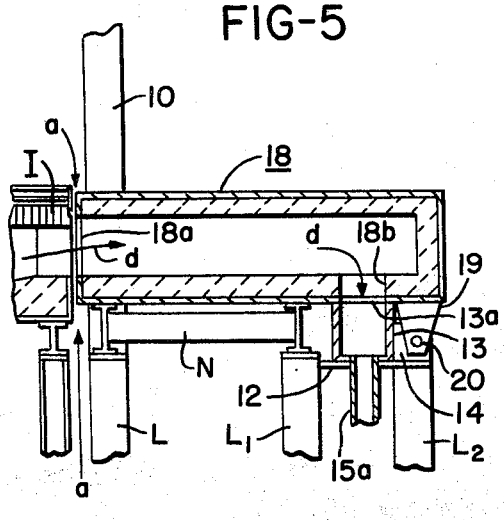
FIG. 5 is a fragmental side section in elevation on the scale of FIG. 2 showing an exhaust chest that is swingably mounted on the platform or table that receives the scrap preheating container and that is moved from an upwardly backwardly inclined out-of-the-way position of FIG. 1 to the "down" connecting position of this figure when the scrap container has been swung to a furnace charging position or removed for recharging from its furnace fume receiving adjacent position.

As previously indicated, auxiliary exhaust chest 18 has a pair of swing ears or arms 19 carried on a swing shaft 20 for swinging from its out-of-the-way backwardly tilted position of FIG. 2 to its forward, substantially horizontal extending positioning of FIG. 5, when the container 25 is no longer receiving fume from the exhaust port of the furnace. In this manner, the atmospheric environment may be given maximum protection from the standpoint of hot fume or exhaust gas from the furnace, even when the gas is not being used for preheating or other purposes. This is clearly distinguished from the atmospheric contamination that occurs when, for example, a unitary roof is provided which is removable to fully expose the furnace interior for charging it by means of scrap buckets.

Figure 6:
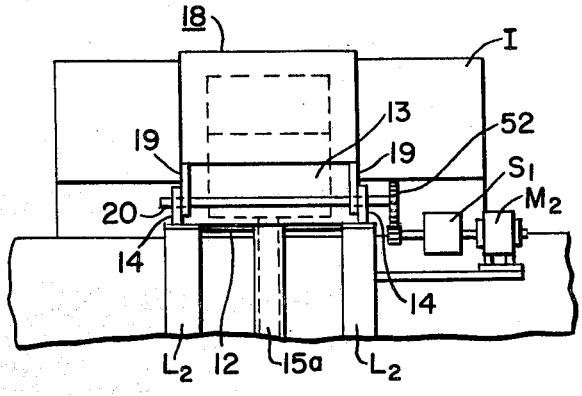
FIG. 6 is a fragmental back view in elevation on the scale of and of the apparatus shown in FIG. 5.

The chest 18, as shown also in FIG. 6, is swingably actuated by a motor $M_2$, a gear reduction unit $S_1$, a connecting gear assembly $S_2$, and a swivel shaft 20. The shaft 20 is secured to extend from opposite ends of the arms 19 and is pivotally mounted with respect to a pair of upright ears 14 that are carried by the platform 12

(see FIG. 5) and its pairs of supporting columns or buckstays $L_1$ and $L_2$.

I claim:

1. In a method of preheat-conditioning and feeding metal scrap into a melting furnace having a roof provided with a charging opening through which a preheated metal scrap body is to be fed, and having a hot fume exhaust port which comprises the steps of: filling a scrap bucket with a body of metal scrap to be preheated, placing the filled scrap bucket in a closed-off upright position adjacent the furnace, positively moving hot fume directly from the exhaust port through the body of metal scrap from its bottom portion in an enclosed relation within the bucket and then from an opposite bottom portion into an outflow duct for environmental treatment before discharge into the atmosphere, continuing the defined movement of the hot fume to preheat the scrap body, thereafter swinging the scrap bucket with the preheated scrap therein on a fixed position pivot support above and adjacent the furnace from its hot fume-receiving position into a top endwise open scrap charging position and progressively charging its preheated scrap content through the charging opening into the furnace, and when the scrap bucket with its preheated scrap content has been swung out of its fume-receiving position with the exhaust port then swinging an exhaust connector into a direct interconnecting flow relation between the exhaust port and the outlet duct to avoid directly exhausting hot fume into the ambient atmosphere.

2. In a method of preheating and feeding metal scrap into a melting furnace having a charging opening through which a preheated charging body of scrap is to be fed, and having a hot fume exhaust port which comprises the steps of: filling a scrap bucket with a body of metal scrap material to be preheated, placing the filled scrap bucket in an upright position adjacent the furnace and positively flowing hot fume from the exhaust port through the enclosed body of metal scrap within the container and then into an outflow duct for environmental treatment before discharge, continuing the defined movement of the hot fume to preheat the scrap body, thereafter moving the container with the preheated scrap therein from its adjacency with the fume exhaust port and progressively feeding its preheated scrap content through the opening into the furnace, during the positive flow of hot fume into the scrap material within the container, first moving the fume upwardly through a front portion of the enclosed body of scrap and then downwardly through a back portion thereof into the outflow duct, positioning the front portion of the enclosed body of scrap in a separately chambered relation with respect to the back portion thereof whereby the front portion receives a higher temperature preheat than the back portion thereof, and after the enclosed body of scrap has been preheated within the container by the hot fume, introducing it into the charging opening in such a manner as to feed the hotter and cooler portions of the preheated scrap body in a mixed relation into the furnace.

3. A method as defined in claim 2 which involves introducing the hotter and cooler portions of the preheated scrap body through the charging opening in a substantially half and half proportioned relation.

4. A method as defined in claim 2 which involves mixing temperature-lowering air with the hot fume after it leaves the exhaust port and before it enters the enclosed body of scrap material to lower the hot fume to a suitable scrap preheatingtemperature.

5. A method as defined in claim 2 which involves swingably carrying a feed guide adjacent the furnace opening and swinging it into a cooperating overlapping position between the scrap bucket and the charging furnace opening before the preheated scrap material is fed into the opening to guide the preheated scrap in a non-spilling manner into the opening.

6. A method of conditioning and feeding metal scrap into a melting furnace having a removable roof portion that exposes an opening through which a preheated charging body of scrap is to be fed, and having a side-positioned hot fume exhaust port which comprises the steps of: placing an enclosed upright body of loose scrap material in connected adjacency with the exhaust port for receiving hot fume therefrom, moving the hot fume from the exhaust port and applying tempering air therethrough, positively moving the tempered hot fume through the enclosed body of scrap in an inverted U-shaped path and then into an outflow duct for environment treatment before discharge, continuing the defined movement of the tempered hot fume until the scrap body is preheated, thereafter tilting the body of preheated scrap forwardly away from its connected adjacency with the fume exhaust port towards the furnace opening, swinging a guide means into an aligned feeding position with the tilted body of preheated scrap, and then progressively feeding the preheated scrap along the guide means through the opening into the furnace.

7. A method as defined in claim 6 which involves first moving the hot fume upwardly through a front portion of the body of scrap and then downwardly through a back portion thereof into the outflow duct.

8. A method as defined in claim 7 which involves positioning the front portion of the body of scrap in a separated chambered relation with respect to the back portion thereof whereby the front portion receives a higher temperature preheat than the back portion thereof, and after preheating the body of scrap by the tempered hot fume, introducing it into the furnace through the opening therein in such a manner that its hotter and cooler portions are fed in a substantially mixed relation into the furnace.

9. A method as defined in claim 7 which involves separating and insulating a front portion of the body of scrap from the back portion thereof during the preheating operation.

10. In a furnace scrap charging construction wherein a melting furnace is provided with a charging opening in a top portion thereof and with a side-positioned fume exhaust port open therefrom for discharging hot fume, the improvement which comprises: a platform positioned adjacent the exhaust port of the furnace, an elongated chamber-defining scrap-receiving-preheating container adapted to be lifted into and out of an upright scrap preheating position on said platform, an exhaust duct carried by said platform, said container having enclosed side and bottom walls and a bottom entry port adapted to be aligned with the exhaust and having a bottom outlet port adapted to be aligned with said exhaust duct to discharge fume thereto for environmental treatment when said container is positioned on said platform, an upright member extending from said platform adjacent the furnace and having swing supporting bracket means adjacent an upper end thereof, swing pivot means carried by a side of said container and adapted to swingably rest on said bracket means in such a manner that said container is swingable from its upright position on said platform to a downwardly forwardly inclined preheated scrap charging position with respect to the charging opening, and said container having an upper end portion provided with a swingable lid that is adapted to swing forwardly into an inclined open scrap-guiding position with respect to the furnace charging opening when said container is tilted on said bracket means into a preheated scrap feeding position with respect to the charging opening in the furnace.

11. A furnace charging apparatus as defined in claim 10 wherein said bracket means is upwardly open to removably receive said swing pivot means.

12. A furnace charging construction as defined in claim 10 wherein guide means of collar-like shape is swingably carried by the roof portion of the furnace for movement from an upright out of the way position adjacent said container when said container is positioned on said platform and into an aligned adjacency between the charging opening, said swingable lid and the open end portion of said container when said container is tilted into a scrap charging position with the charging opening.

13. A furnace charging construction as defined in claim 12 wherein motor drive means is operatively connected to said guide means for swinging it into and out of aligned adjacency with the charging opening of the furnace.

14. A furnace charging construction as defined in claim 10 wherein an auxiliary exhaust chest is swingably carried by said platform for movement into a connecting position between the exhaust port of the furnace and said exhaust duct when the exhaust port is exposed to the atmosphere by movement of said container into a scrap charging position.

15. In a furnace scrap charging construction wherein a melting furnace is provided with a refractory roof adapted to be lifted out of and lowered into a closing position with a charging opening in the top of the furnace, and wherein a side-positioned fume exhaust port is open from the furnace for charging hot fume therefrom, the improvement which comprises: a platform positioned adjacent the exhaust port of the furnace and an elongated chamber-defining scrap-receiving preheating container adapted to be moved into and out of an upright scrap preheating position on said platform, an exhaust duct carried by said platform, said container having enclosing side and bottom walls defining a chamber area and an entry port adapted to be aligned with the fume exhaust port to receive hot fume therefrom and defining an exit port adapted to be aligned with said exhaust duct, an upright support frame carried by said platform, said container and said frame having a cooperating swing means for removably receiving and supporting said container on said platform and for enabling a swinging movement of said container from an upright position on said platform to a downwardly forwardly tilted preheated scrap feeding position with respect to the charging opening of the furnace, said container also having a central partition dividing its chamber area into a front high temperature scrap preheating compartment directly open to said entry port and a back lower temperature scrap preheating compartment directly open to said exhaust port, and said container having a cross-extending open portion across said partition for cross flow of exhaust fume from said front into said back compartment.

16. A furnace charging construction as defined in claim 15 wherein an auxiliary exhaust chest is operatively carried by said platform for swinging movement into a connected relation between the furnace exhaust port and said exhaust duct when said preheating container has been moved out of its preheating position on said platform.

17. A furnace charging construction as defined in claim 15 wherein, said exhaust duct has means positively inducing a flow of hot fume from the exhaust port of the furnace upwardly through scrap within said front compartment, across said cross-extending open portion, downwardly through scrap within said back compartment, and from said back compartment into said exhaust duct.

18. A furnace charging construction as defined in claim 15 wherein, said partition is refractory lined, and said container has a swingable lid adapted to, in its closed position, extend in a spaced relation over said cross-extending portion which is in open communication between said front and back scrap preheating compartments.

19. A furnace charging construction as defined in claim 15 wherein, means is provided for mixing temperature-lowering air with the hot fume from the furnace before it is introduced into said entry port of said container and into contact with scrap to be preheated to reduce its temperature below a value that will cause sticking of scrap subjected thereto.

* * * * *